US011721259B2

(12) United States Patent
Lee et al.

(10) Patent No.: US 11,721,259 B2
(45) Date of Patent: Aug. 8, 2023

(54) DISPLAY DRIVING DEVICE AND DISPLAY DRIVING METHOD FOR REDUCING POWER USING ENERGY HARVESTING DEVICE

(71) Applicant: LX SEMICON CO., LTD., Daejeon (KR)

(72) Inventors: Jong Suk Lee, Daejeon (KR); Young Bok Kim, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/537,746

(22) Filed: Nov. 30, 2021

(65) Prior Publication Data

US 2022/0172660 A1 Jun. 2, 2022

(30) Foreign Application Priority Data

Dec. 1, 2020 (KR) ..... 10-2020-0165519

(51) Int. Cl.

| | |
|---|---|
| ***G09G 3/20*** | (2006.01) |
| *G09G 3/36* | (2006.01) |
| *G09G 3/3275* | (2016.01) |

(52) U.S. Cl.

CPC ..... *G09G 3/20* (2013.01); *G09G 3/3275* (2013.01); *G09G 3/3648* (2013.01);
(Continued)

(58) Field of Classification Search

CPC ..... G09G 3/20; G09G 2300/0408; G09G 2310/08; G09G 2320/041; G09G 2330/02;
(Continued)

(56) References Cited

U.S. PATENT DOCUMENTS

2014/0014154 A1* 1/2014 Hayashi ..... H01L 35/32 136/205
2016/0013671 A1* 1/2016 Yang ..... H01L 35/32 320/101
(Continued)

FOREIGN PATENT DOCUMENTS

KR 10-2015-0025035 A 3/2015
KR 10-2019-0032802 A 3/2019

*Primary Examiner* — Adam J Snyder
(74) *Attorney, Agent, or Firm* — Rothwell, Figg, Ernst & Manbeck, P.C.

(57) ABSTRACT

There is disclosed a display driving device configured to drive a display device for displaying an image, including a source driver integrated circuit (IC) configured to convert image data into a source signal, and an energy harvesting device configured to convert thermal energy into electrical energy and supply the electrical energy to the source driver IC, wherein the energy harvesting device includes a thermal energy converter configured to convert thermal energy generated in the source driver IC to output an energy harvesting current, and an energy storage directly connected to the thermal energy converter, and configured to receive the energy harvesting current, store power, and output a first auxiliary voltage that is a voltage generated due to the stored power, wherein the thermal energy converter and the energy storage are located on the source driver IC.

11 Claims, 5 Drawing Sheets

(52) U.S. Cl.
CPC . *G09G 2300/0408* (2013.01); *G09G 2310/08* (2013.01); *G09G 2320/041* (2013.01); *G09G 2330/00* (2013.01); *G09G 2330/02* (2013.01); *G09G 2330/021* (2013.01)

(58) Field of Classification Search
CPC ..... G09G 2330/021; G09G 3/3275; G09G 3/3648; G09G 2330/00; G05F 1/10
See application file for complete search history.

(56) References Cited

U.S. PATENT DOCUMENTS

| | | | | |
|---|---|---|---|---|
| 2016/0027986 | A1* | 1/2016 | Kim | H10N 19/00 136/200 |
| 2016/0124489 | A1* | 5/2016 | Kang | G06F 1/3265 713/323 |
| 2018/0158429 | A1* | 6/2018 | Na | G09G 3/3688 |
| 2020/0005724 | A1 | 1/2020 | Na et al. | |

* cited by examiner

DISPLAY DRIVING DEVICE AND DISPLAY DRIVING METHOD FOR REDUCING POWER USING ENERGY HARVESTING DEVICE

CROSS-REFERENCE TO RELATED APPLICATIONS

This application claims the benefit of the Korean Patent Applications No. 10-2020-0165519 filed on Dec. 1, 2020 which are hereby incorporated by reference as if fully set forth herein.

FIELD OF THE INVENTION

The present specification relates to a display driving device and a display driving method.

BACKGROUND

Representative examples of a display device for displaying an image include a liquid crystal display (LCD) using liquid crystals, an organic light-emitting diode (OLED) display using an OLED, and the like. A technique for reducing the power consumption of the display device has been developed.

However, it is difficult to reduce power essentially consumed to perform each function in a display panel and a display driving device constituting the display device.

SUMMARY

The present disclosure is directed to providing a display driving device and a display driving method allowing power consumed in the display driving device to be reduced using an energy harvesting device.

According to an aspect of the present disclosure, there is provided a display driving device configured to drive a display device for displaying an image, including a source driver integrated circuit (IC) configured to convert image data into a source signal, and an energy harvesting device configured to convert thermal energy into electrical energy and supply the electrical energy to the source driver IC, wherein the energy harvesting device includes a thermal energy converter configured to convert thermal energy generated in the source driver IC to output an energy harvesting current, and an energy storage directly connected to the thermal energy converter, and configured to receive the energy harvesting current, store power, and output a first auxiliary voltage that is a voltage generated due to the stored power, wherein the thermal energy converter and the energy storage are located on the source driver IC.

According to another aspect of the present disclosure, there is provided a display driving method including converting thermal energy generated in a source driver integrated circuit (IC) to output an energy harvesting current, receiving the energy harvesting current and storing power, generating a first auxiliary voltage using the stored power, and outputting a second auxiliary voltage of a constant level corresponding to the first auxiliary voltage.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
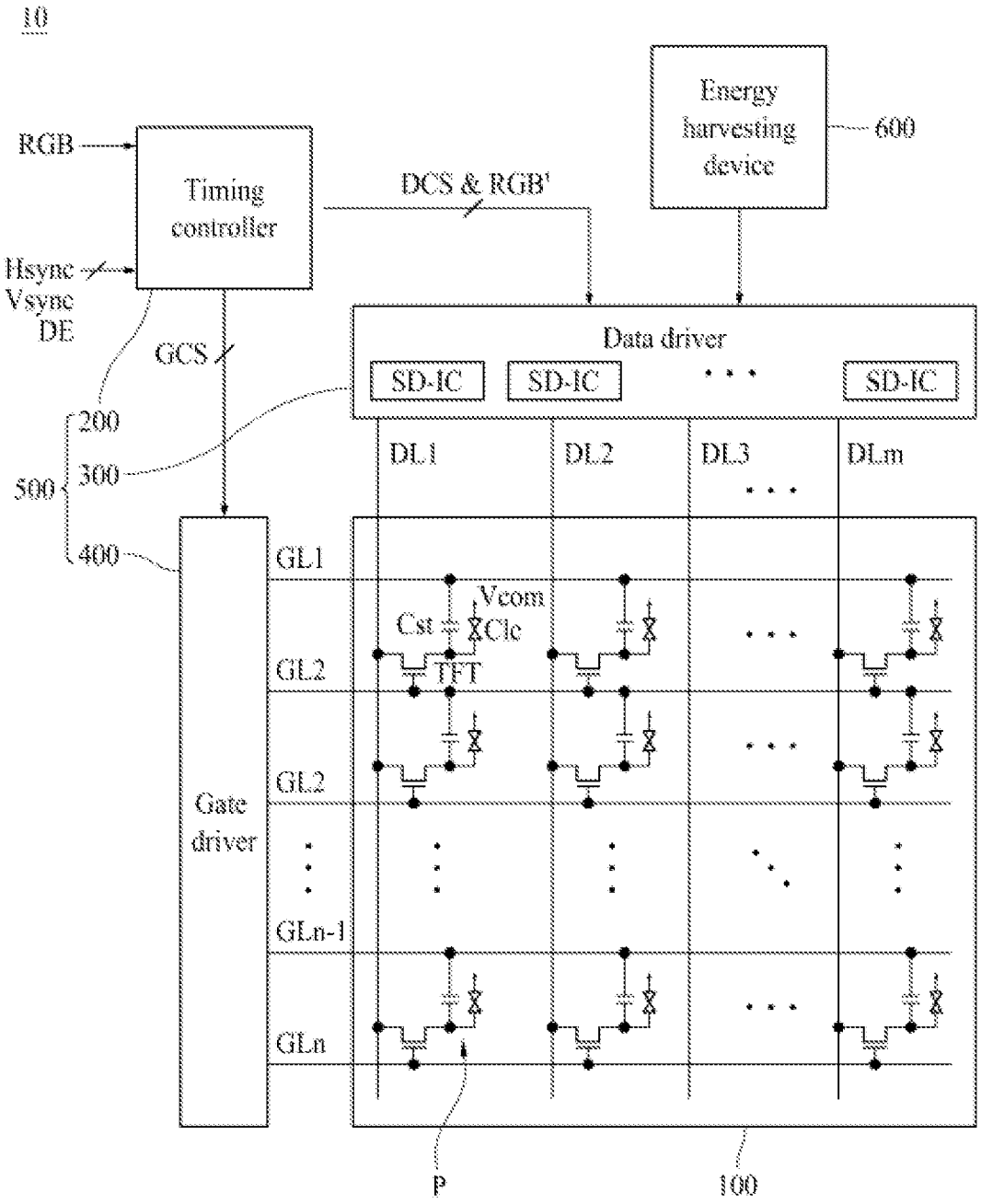
FIG. 1 is a diagram illustrating a configuration of a display device including a display driving device according to one embodiment of the present disclosure.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, a display device including a display driving device according to an embodiment of the present disclosure will be described in detail with reference to FIG. 1.

FIG. 1 is a diagram illustrating a configuration of a display device including a display driving device according to one embodiment of the present disclosure. As shown in FIG. 1, a display device 10 includes a display panel 100 and a display driving device 500, and the display driving device 500 includes a timing controller 200, a data driver 300, a gate driver 400, and an energy harvesting device 600.

The display panel 100 includes a plurality of gate lines GL1 to GLn and a plurality of data lines DL1 to DLm, which are arranged to intersect each other and define a plurality of pixel regions, and a pixel P provided in each of the plurality of pixel regions. The plurality of gate lines GL1 to GLn may be arranged in a transverse direction and the plurality of data lines DL1 to DLm may be arranged in a longitudinal direction, but the present disclosure is not necessarily limited thereto.

The display panel 100 may be a liquid crystal display (LCD) panel. When the display panel 100 is an LCD panel, the display panel 100 includes thin-film transistors (TFTs) and liquid crystal cells connected to the TFTs, which are formed in the pixel regions defined by the plurality of gate lines GL1 to GLn and the plurality of data lines DL1 to DLm.

The TFT transmits a data signal supplied through the data lines DL1 to DLm to the liquid crystal cell in response to a scan pulse supplied through the gate lines GL1 to GLn.

The liquid crystal cell is composed of a common electrode and a sub-pixel electrode, which is connected to the TFT, facing each other with a liquid crystal therebetween, and thus may be equivalently expressed as a liquid crystal capacitor Clc. The liquid crystal cell includes a storage capacitor Cst connected to the gate line of a previous stage in order to maintain a voltage corresponding to a source signal charged in the liquid crystal capacitor Clc until a voltage corresponding to a next source signal is charged.

Meanwhile, the pixel regions of the display panel 100 may include red (R), green (G), blue (B), and white (W) subpixels. Each of the subpixels may be repeatedly formed in a row direction or formed in a matrix form of 2×2. In this case, a color filter corresponding to each color is disposed in each of the red (R), green (G), and blue (B) subpixels, but a separate color filter is not disposed in the white (W) subpixel. The red (R), green (G), blue (B), and white (W) subpixels may be formed to have the same area ratio, but may also be formed to have different area ratios.

Although the display panel 100 is described as being an LCD panel, the display panel 100 may be an organic light-emitting diode (OLED) display panel in which an OLED is formed in each pixel region.

The timing controller 200 receives various timing signals including a vertical synchronization signal Vsync, a horizontal synchronization signal Hsync, a data enable signal DE, a clock signal CLK, and the like from an external system (not shown), and generates a data control signal DCS for controlling the data driver 300 and a gate control signal GCS for controlling the gate driver 400. In addition, the timing controller 200 receives an image data RGB from the external system, converts the received image data RGB into an image data RGB' in a form that can be processed by the data driver 300, and outputs the converted image data RGB'.

The data driver 300 converts the aligned image data RGB' into a source signal according to the data control signal DCS generated by the timing controller 200. The data control signal DCS may include a source start pulse SSP, a source sampling clock SSC, a source output enable signal SOE, and the like. Here, the source start pulse controls a data sampling start timing of a signal converter. The source sampling clock is a clock signal which controls a sampling timing of data in each of source driver integrated circuits (ICs). The source output enable signal controls an output timing of the signal converter of each of the source driver ICs. That is, the data driver 300 converts the aligned image data RGB' into the source signal according to the source start pulse, the source sampling clock, and the source output enable signal, and outputs the source signals corresponding to one horizontal line to the data lines every one horizontal period at which the gate signals are supplied to the gate lines. Here, the signal converter may receive a gamma voltage from a gamma voltage generator (not shown) and convert the aligned image data RGB' into the source signal using the gamma voltage. To this end, the data driver 300 includes n source driver ICs SD-IC.

The gate driver 400 outputs the gate signals, which are synchronized with the source signals generated by the data driver 300, to the gate lines in response to the gate control signal GCS generated by the timing controller 200. The gate control signal GCS may include a gate start pulse GSP, a gate shift clock GSC, a gate output enable signal, and the like. Here, the gate start pulse controls an operation start timing of m gate driver ICs (not shown) that configure the gate driver 400. The gate shift clock is a clock signal which is commonly input to one or more gate driver ICs and controls a shift timing of a scan signal (gate pulse). The gate output enable signal designates timing information of one or more gate driver ICs. That is, the gate driver 400 outputs the gate signals, which are synchronized with the source signals according to the gate start pulse, the gate shift clock, and the gate output enable signal that are generated by the timing controller 200, to the gate lines.

The gate driver 400 includes a gate shift register circuit, a gate level shifter circuit, and the like. In this case, the gate shift register circuit may be formed directly on a TFT array substrate of the display panel 100 by a gate-in-panel (GIP) process. In this case, the gate driver 400 supplies the gate start pulse and the gate shift clock signal to the gate shift register circuit that is formed on the TFT array substrate by a GIP process.

According to one embodiment of the present disclosure, the energy harvesting device 600 converts thermal energy into electrical energy and supplies the electrical energy to the source driver IC SD-IC constituting the data driver 300. The energy harvesting device 600 includes a thermal energy converter 610, an energy storage 620, and a voltage stabilizer 630. The energy harvesting device 600 according to one embodiment of the present disclosure will be described below in detail with reference to FIGS. 2 and 3.

Figure 2:
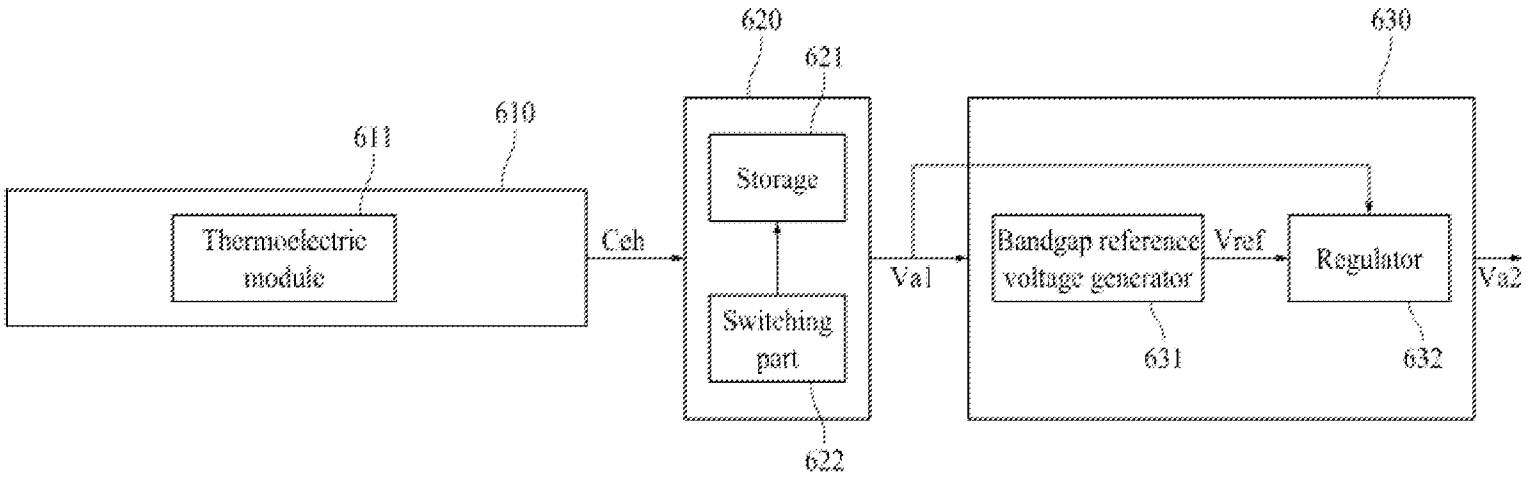
FIG. 2 is a view illustrating a configuration of the energy harvesting device according to one embodiment of the present disclosure.
Figure 3:
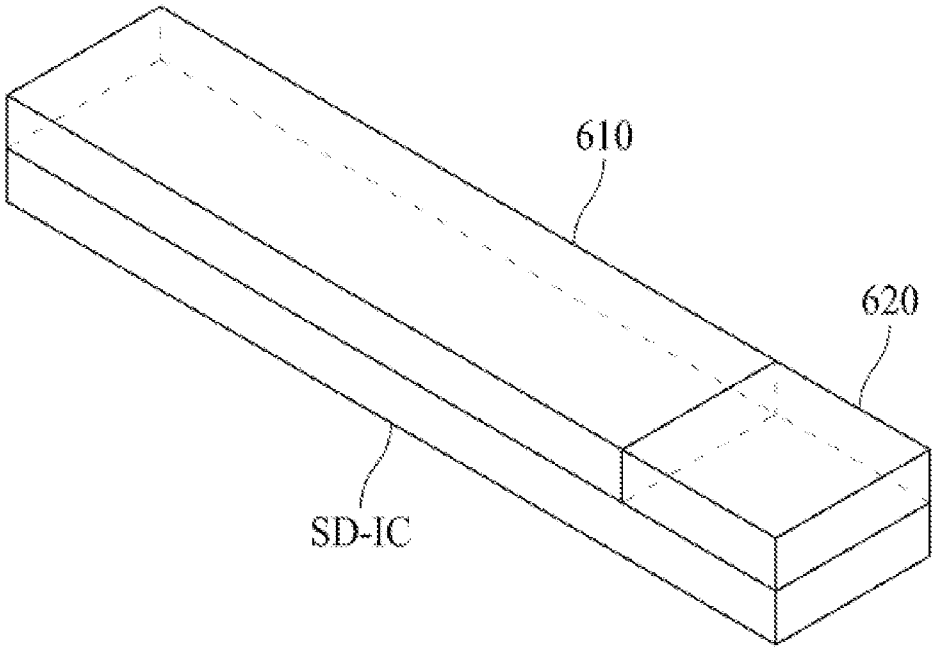
FIG. 3 is a diagram illustrating a structure of a source driver integrated circuit (IC) and an energy harvesting device according to one embodiment of the present disclosure.
Figure 4A:
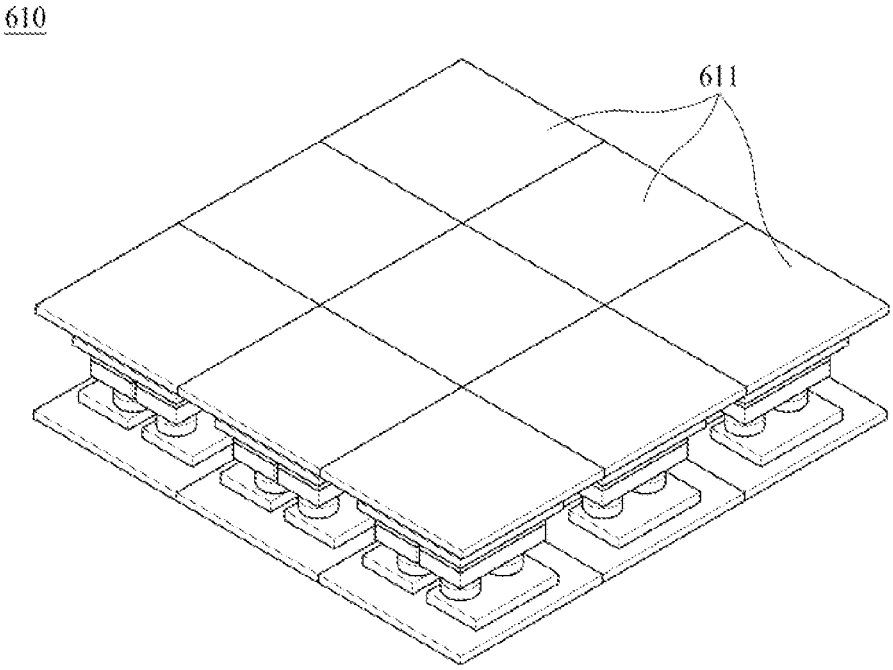
FIG. 4A is a view illustrating a thermal energy converter including a plurality of thermoelectric modules according to one embodiment of the present disclosure.
Figure 4B:
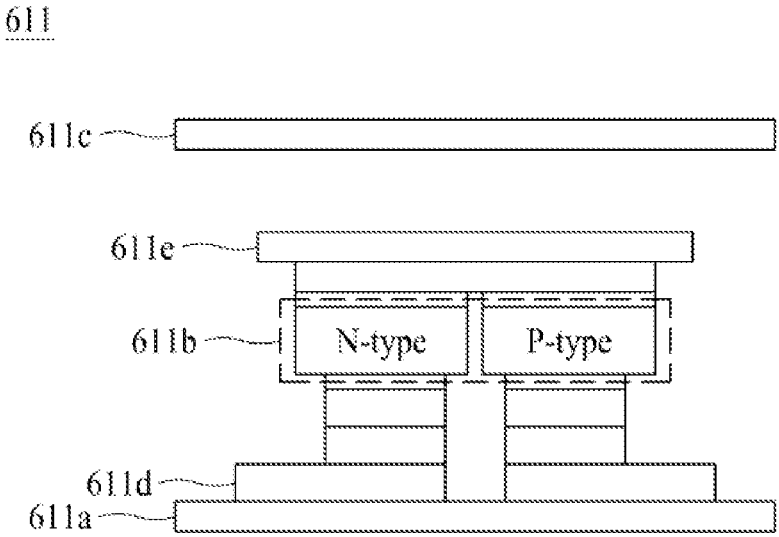
FIG. 4B is a view illustrating a structure of the thermoelectric module according to one embodiment of the present disclosure.

Hereinafter, the energy harvesting device according to the present disclosure will be described in detail with reference to FIGS. 2 to 4B. FIG. 2 is a view illustrating a configuration of the energy harvesting device according to one embodiment of the present disclosure, and FIG. 3 is a diagram schematically illustrating a structure of the source driver IC and the energy harvesting device according to one embodiment of the present disclosure. FIG. 4A is a view illustrating the thermal energy converter including a plurality of thermoelectric modules according to one embodiment of the present disclosure, and FIG. 4B is a view illustrating a structure of the thermoelectric module according to one embodiment of the present disclosure.

The energy harvesting device 600 absorbs thermal energy generated from the surroundings thereof, and converts the absorbed thermal energy into electrical energy and outputs the electrical energy.

As shown in FIGS. 2 and 3, the energy harvesting device 600 according to one embodiment of the present disclosure includes the thermal energy converter 610, the energy storage 620, and the voltage stabilizer 630.

The thermal energy converter 610 converts thermal energy into electrical energy and outputs the electrical energy. Specifically, the thermal energy converter 610 absorbs thermal energy generated in the source driver IC SD-IC and converts the absorbed thermal energy to output an energy harvesting current Ceh. At this point, the thermal energy converter 610 according to one embodiment of the present disclosure may be disposed to be in contact with the source driver IC SD-IC to effectively absorb the thermal energy generated in the source driver IC SD-IC.

According to one embodiment of the present disclosure, since the thermal energy converter 610 is directly connected to the energy storage 620 to be described below, the energy harvesting current Ceh, which does not pass through a separate rectifier circuit, is directly output to the energy storage 620.

As shown in FIG. 4A, the thermal energy converter 610 includes a plurality of thermoelectric modules 611 configured to convert thermal energy generated in the source driver IC SD-IC into electrical energy. The plurality of thermoelectric modules 611 may be arranged in the form of a matrix of n×m (where n and m are positive integers), and may be disposed on the source driver IC SD-IC in the form of a film and integrally configured with the source driver IC SD-IC.

According to one embodiment of the present disclosure, as shown in FIG. 3, the thermal energy converter 610 has a smaller area than the source driver IC SD-IC, and may be integrally configured with the energy storage 620 and the source driver IC SD-IC on the source driver IC SD-IC. For example, the thermal energy converter 610 may have a width less than or equal to that of the source driver IC SD-IC, and may have a length less than that of the source driver IC SD-IC. Accordingly, the area and volume occupied by the source driver IC SD-IC and the energy harvesting device 600 may be minimized.

Referring to FIG. 4B, the thermoelectric module 611 may include a first substrate 611*a* configured to absorb heat, a unit cell 611*b* including a P-type semiconductor and an N-type semiconductor, a second substrate 611*c* disposed opposite to the first substrate 611*a*, a first electrode 611*d* disposed between the first substrate 611*a* and the unit cell 611*b*, and a second electrode 611*e* disposed between the second substrate 611*c* and the unit cell 611*b*. The P-type semiconductor is a P-type thermoelectric semiconductor that allows holes to move so that thermal energy is transferred, and the N-type semiconductor is an N-type thermoelectric semiconductor that allows electrons to move so that thermal energy is transferred. In addition, the thermoelectric module 611 may further include a dielectric layer located between the first electrode 611*d* and the unit cell 611*b*, and between the unit cell 611*b* and the second electrode 611*e*. However, the thermoelectric module 611 is not limited thereto and may include a material or structure for converting thermal energy into electrical energy.

The energy storage 620 receives the energy harvesting current Ceh, and accordingly, when a voltage generated due to power stored in the energy storage 620 is greater than or equal to a usable voltage, a first auxiliary voltage Va1 is output to the voltage stabilizer 630. As the energy harvesting current Ceh is input to the energy storage 620, the amount of power stored in the energy storage 620 increases to increase the voltage generated by the amount of stored power, and when the increased voltage is greater than or equal to the usable voltage, the first auxiliary voltage Va1 that is a voltage generated due to the power stored in the energy storage 620 is output.

According to one embodiment of the present disclosure, since the energy storage 620 directly receives the energy harvesting current Ceh, which is not rectified, from the thermal energy converter 610, the first auxiliary voltage Va1 output from the energy storage 620 may include noise, and thus the first auxiliary voltage Va1 is rectified through the voltage stabilizer 630, which will be described below.

According to one embodiment of the present disclosure, the energy storage 620 is disposed on the source driver IC SD-IC in the form of a film. Accordingly, the energy storage 620 may be integrally configured with the source driver IC SD-IC so that the area occupied by the energy storage 620 may be reduced.

According to one embodiment of the present disclosure, the energy storage 620 may have a smaller area than the source driver IC SD-IC, and thus may be integrally configured with the thermal energy converter 610 and the source driver IC SD-IC on the source driver IC SD-IC. For example, the energy storage 620 may have a width less than or equal to that of the source driver IC SD-IC, and may have a length less than that of the source driver IC SD-IC. Accordingly, the area and volume occupied by the source driver IC SD-IC and the energy harvesting device 600 may be minimized.

The energy storage 620 includes a storage 621 and a switching part 622.

The storage 621 receives the energy harvesting current Ceh converted from the thermal energy, stores power, and outputs the first auxiliary voltage Va1 generated due to the stored power.

The switching part 622 controls the storage 621 to output the first auxiliary voltage Va1 to the voltage stabilizer 630 when the voltage generated due to the power stored in the storage 621 is greater than or equal to a usable voltage.

The voltage stabilizer 630 rectifies the first auxiliary voltage Va1 output from the energy storage 620 to output a second auxiliary voltage Va2. In detail, since the energy storage 620 receives the energy harvesting current Ceh, which is not rectified, the first auxiliary voltage Va1 output from the energy storage 620 may include noise. Accordingly, the voltage stabilizer 630 rectifies the first auxiliary voltage Va1 output from the energy storage 620, and outputs the second auxiliary voltage Va2, which is obtained by rectifying the first auxiliary voltage Va1, to the source driver IC SD-IC.

Although not shown in the drawings, according to one embodiment of the present disclosure, the voltage stabilizer 630 may be disposed on the source driver IC SD-IC to be integrally configured with the source driver IC SD-IC. Accordingly, the area and volume of the energy harvesting device 600 and the source driver IC SD-IC may be minimized.

Alternatively, according to another embodiment of the present disclosure, the voltage stabilizer 630 may be embedded in the source driver IC SD-IC. Accordingly, the energy harvesting device 600 and the source driver IC SD-IC may be reduced in area and volume and light in weight.

Referring to FIG. 2 again, the voltage stabilizer 630 includes a bandgap reference voltage generator 631 and a regulator 632.

The bandgap reference voltage generator 631 generates a reference voltage Vref that maintains a constant level even when the temperature changes, and provides the reference voltage Vref to the regulator 632, which will be described below.

Since the energy harvesting device 600 according to one embodiment of the present disclosure outputs the second auxiliary voltage Va2 using the reference voltage Vref generated by the bandgap reference voltage generator 631, the energy harvesting device 600 may supply the second auxiliary voltage Va2 of a more stable level to the source driver IC SD-IC.

The regulator 632 outputs the second auxiliary voltage Va2 corresponding to the first auxiliary voltage Va1 to the source driver IC SD-IC using the reference voltage Vref generated from the bandgap reference voltage generator 631.

In the voltage stabilizer 630 according to one embodiment of the present disclosure, a direct current (DC)-DC converter including an inductor is replaced with the bandgap reference voltage generator 631 and the regulator 632 so that power loss caused by the inductor of the DC-DC converter may be prevented, and complex analog circuits are replaced with the bandgap reference voltage generator 631 and the regulator 632 so that a circuit area of the voltage stabilizer 630 may be reduced.

Figure 5:
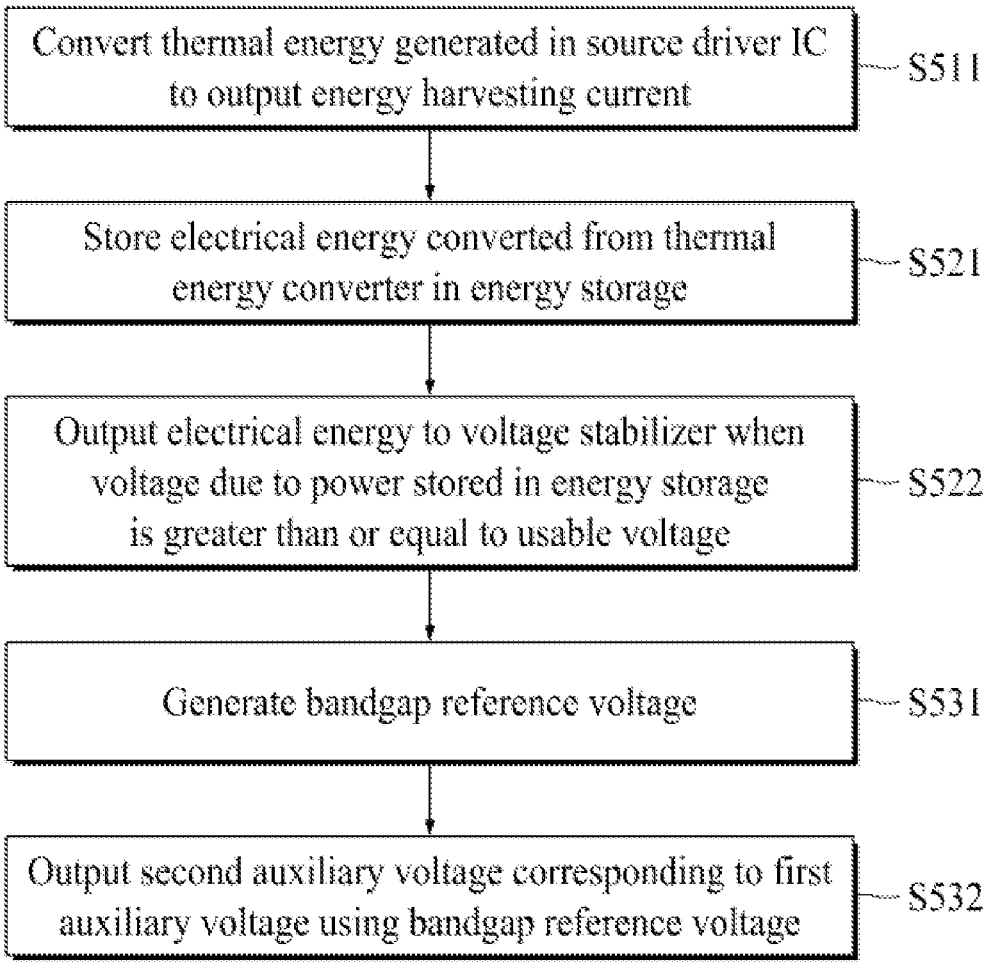
FIG. 5 is a flowchart illustrating an energy harvesting process of the energy harvesting device and the display driving device according to one embodiment of the present disclosure.

Hereinafter, an energy harvesting process of the energy harvesting device and the display driving device according to the present disclosure will be described in detail with reference to FIG. 5. FIG. 5 is a flowchart illustrating an energy harvesting process of the energy harvesting device and the display driving device according to one embodiment of the present disclosure.

Operation S511 is performed by the thermal energy converter 610, operations S521 and S522 are performed by the energy storage 620, and operations S531 and S532 are performed by the voltage stabilizer 630.

First, the energy harvesting device 600 converts thermal energy generated in the source driver IC SD-IC to output an energy harvesting current Ceh (S511).

Thereafter, the energy harvesting device 600 stores electrical energy converted by the thermal energy converter 610 in the energy storage 620 (S521). Specifically, the energy harvesting device 600 stores the energy harvesting current Ceh, which is converted from the thermal energy by the thermal energy converter 610, in the energy storage 620.

Thereafter, the energy harvesting device 600 outputs the electrical energy stored in the energy storage 620 to the voltage stabilizer 630 when a voltage due to the amount of the power stored in the energy storage 620 is greater than or equal to a usable voltage (S522). Specifically, when the voltage due to the amount of power stored in the energy storage 620 is greater than or equal to the usable voltage, the switching part 622 controls the storage 621 to output the stored power.

Thereafter, the energy harvesting device 600 generates a reference voltage Vref that maintains a constant level even when the temperature changes (S531).

Thereafter, the energy harvesting device 600 outputs a second auxiliary voltage Va2 corresponding to a first auxiliary voltage Va1 to the source driver IC SD-IC using the reference voltage Vref (S532).

It will be understood by those skilled in the art that the present disclosure described above may be implemented in other specific forms without changing the technical spirit or essential characteristics thereof.

Further, the methods described herein may be implemented, at least in part, using one or more computer programs or components. The components may be provided as a series of computer instructions on a conventional computer readable medium or machine readable medium, including a volatile or non-volatile memory. The instructions may be provided as software or firmware, and may, in whole or in part, be implemented in a hardware configuration such as application-specific integrated circuits (ASICs), field-programmable gate arrays (FPGAs), digital signal processors (DSPs), or other similar devices. The instructions may be configured to be executed by one or more processors or other hardware configurations, and the processor or other hardware components may perform all or part of the methods and procedures disclosed herein when executing the series of computer instructions.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

A display driving device and a display driving method according to the present disclosure can reduce power consumed in the display driving device by converting ambient thermal energy into electrical energy and supplying the electrical energy to the display driving device.

Further, a display driving device and a display driving method according to the present disclosure can prevent power loss caused by an inductor of a DC-DC converter by replacing the DC-DC converter including an inductor with a bandgap reference voltage generator and a regulator, and reduce a circuit area.

DESCRIPTION OF REFERENCE NUMERALS

10: display device
100: display panel
500: display driving device
200: timing controller
300: data driver
400: gate driver

What is claimed is:

1. A display driving device configured to drive a display device for displaying an image, the display driving device comprising:

a source driver integrated circuit (IC) configured to convert image data into a source signal; and an energy harvesting device configured to convert thermal energy into electrical energy and supply the electrical energy to the source driver IC, wherein the energy harvesting device includes:

a thermal energy converter configured to convert thermal energy generated in the source driver IC to output an energy harvesting current; and an energy storage directly connected to the thermal energy converter, and configured to receive the energy harvesting current, store power, and output a first auxiliary voltage that is a voltage generated due to the stored power when the first auxiliary voltage that is a voltage generated due to the stored power is greater than or equal to a usable voltage, wherein the thermal energy converter and the energy storage are located on the source driver IC, wherein the thermal energy converter and the energy storage are integrally configured with the source driver IC, and wherein the thermal energy converter includes a plurality of thermoelectric modules configured to convert the absorbed thermal energy into the energy harvesting current, and a plurality of thermoelectric modules in contact with the source driver IC to absorb the thermal energy generated in the source driver IC.

2. The display driving device of claim 1, wherein the display driving device further includes a voltage stabilizer configured to output a second auxiliary voltage of a constant level, which corresponds to the first auxiliary voltage, to the source driver IC.

3. The display driving device of claim 2, wherein the voltage stabilizer is located on the source driver IC.

4. The display driving device of claim 2, wherein the voltage stabilizer is embedded in the source driver IC.

5. The display driving device of claim 1, further comprising:

a bandgap reference voltage generator configured to output a reference voltage that maintains a constant level in response to temperature changes; and a voltage stabilizer including a regulator configured to output a second auxiliary voltage corresponding to the first auxiliary voltage to the source driver IC using the reference voltage.

6. The display driving device of claim 1, wherein the thermal energy converter and the energy storage are provided in the form of a film.

7. The display driving device of claim 1, wherein the thermal energy converter and the energy storage have a smaller area than the source driver IC, respectively.

8. The display driving device of claim 1, wherein the thermal energy converter and the energy storage have a width less than or equal to that of the source driver IC, respectively, and have a length less than that of the source driver IC, respectively.

9. A display driving method, comprising:

converting thermal energy generated in a source driver integrated circuit (IC) to output an energy harvesting current;

receiving the energy harvesting current and storing power;

generating a first auxiliary voltage using the stored power; and outputting a second auxiliary voltage of a constant level corresponding to the first auxiliary voltage, wherein the generating of the first auxiliary voltage using the stored power includes, when the first auxiliary voltage generated due to the stored power is greater than or equal to a usable voltage, outputting the first auxiliary voltage, and wherein in the converting thermal energy generated in a source driver integrated circuit (IC) to output an energy harvesting current, a thermal energy converter includes a plurality of thermoelectric modules configured to convert the absorbed thermal energy into the energy harvesting current, and a plurality of thermoelectric modules contact with the source driver IC to absorb the thermal energy generated in the source driver IC.

10. The display driving method of claim 9, wherein the outputting of the second auxiliary voltage of the constant level corresponding to the first auxiliary voltage includes:

outputting a reference voltage that maintains a constant level in response to temperature changes; and outputting the second auxiliary voltage corresponding to the first auxiliary voltage using the reference voltage.

11. A display driving device configured to drive a display device for displaying an image, the display driving device comprising:

a source driver integrated circuit (IC) configured to convert image data into a source signal; and an energy harvesting device configured to convert thermal energy into electrical energy and supply the electrical energy to the source driver IC, wherein the energy harvesting device includes:

a thermal energy converter configured to convert thermal energy generated in the source driver IC to output an energy harvesting current; and an energy storage directly connected to the thermal energy converter, and configured to receive the energy harvesting current, store power, and output a first auxiliary voltage that is a voltage generated due to the stored power, wherein the thermal energy converter and the energy storage are located on the source driver IC, the energy storage includes a storage and a switching part, the switching part controls a storage to output the first auxiliary voltage when the first auxiliary voltage generated due to the stored power is greater than or equal to a usable voltage, and the thermal energy converter includes a plurality of thermoelectric modules configured to convert the absorbed thermal energy into the energy harvesting current, and a plurality of thermoelectric modules in contact with the source driver IC to absorb the thermal energy generated in the source driver IC.

* * * * *